US006381769B1

(12) United States Patent
Lofquist, Jr.

(10) Patent No.: US 6,381,769 B1
(45) **Date of Patent: *May 7, 2002**

(54) BATHTUB FOR PERSONS WITH DISABILITIES

(76) Inventor: Alden A. Lofquist, Jr., 103 Sand River Ct., Aiken, SC (US) 29801

( * ) Notice: Subject to any disclaimer, the term of this patent is extended or adjusted under 35 U.S.C. 154(b) by 0 days.

This patent is subject to a terminal disclaimer.

(21) Appl. No.: 09/723,811

(22) Filed: Nov. 28, 2000

Related U.S. Application Data

(63) Continuation-in-part of application No. 09/054,042, filed on Apr. 2, 1998, now Pat. No. 6,151,727.
(60) Provisional application No. 60/043,366, filed on Apr. 2, 1997.

(51) Int. Cl.[7] ..... A47K 3/022
(52) U.S. Cl. ..... 4/555; 4/556; 4/557
(58) Field of Search ..... 4/554–557

(56) References Cited

U.S. PATENT DOCUMENTS

| | | | | |
|---|---|---|---|---|
| 3,864,762 | A | | 2/1975 | Finch et al. |
| 4,034,424 | A | | 7/1977 | Budlong |
| 4,546,506 | A | | 10/1985 | Houle et al. |
| D285,346 | S | | 8/1986 | Sween |
| 4,672,693 | A | | 6/1987 | Schenström |
| 4,796,312 | A | | 1/1989 | Corlew |
| 4,953,241 | A | | 9/1990 | Williams |
| 5,255,400 | A | | 10/1993 | Sween |
| D351,018 | S | | 9/1994 | Bourgraf et al. |
| 5,446,929 | A | | 9/1995 | Sills et al. |
| 5,463,780 | A | | 11/1995 | McAllister et al. |
| 5,701,614 | A | | 12/1997 | Appleford et al. |
| 6,151,727 | A | * | 11/2000 | Lofquist, Jr. ..... 4/555 |

* cited by examiner

*Primary Examiner*—Michael Powell Buiz
*Assistant Examiner*—Kathleen J. Prunner
(74) *Attorney, Agent, or Firm*—Maria Reichmanis

(57) ABSTRACT

An accessible bathtub apparatus for persons with disabilities, including an enclosure with an elevated bed with a seat and a foot well, a door panel, a door seal, connectors operable to pivot the door panel from an open position to a closed position, and retainers that hold the door panel in the open position until released by the user. The elevated bed allows direct lateral access by the user. The bathtub can be installed in a newly-constructed or renovated bathroom. Alternatively, it can be installed on an existing conventional bathtub, thereby avoiding the necessity of removing the old tub before installing the new one. It can be used in private homes, hotels/motels, and other locations; it can be used by persons with disabilities that would otherwise preclude them from bathing unattended or unassisted.

23 Claims, 4 Drawing Sheets

BATHTUB FOR PERSONS WITH DISABILITIES

This application is a continuation-in-part of application Ser. No. 09/054,042, filed Apr. 2, 1998, now U.S. Pat. No. 6,151,727, which claims the benefit of U.S. provisional application Ser. No. 60/043,366, filed Apr. 2, 1997.

BACKGROUND OF THE INVENTION

1. Field of the Invention

The present invention relates to bathtubs and bathtub/shower combinations that satisfy the needs of persons with temporary or permanent disabilities that render use of a conventional bathtub difficult or impossible. In particular, the present invention relates to a bathtub apparatus having a movable front panel and an elevated bed or seat, so that the bathtub can be accessed directly from a wheelchair with only lateral movement.

2. Discussion of Background

Existing bathtubs and bathtub/shower combinations come in a variety of sizes, types and configurations, ranging from older cast iron tubs that are raised on feet, to newer tubs that have oval or rounded rectangular tub recessions set into the tub structure at an angle. Some tubs have built-in Jacuzzi™ or other whirlpool units, heaters, and other devices that add to the user's comfort and enjoyment.

Despite the growing awareness that large numbers of people simply cannot use conventional bathroom fixtures safely (or even use them at all), essentially all present-day bathrooms contain bathtubs designed for the hypothetical "average" adult. Whatever their age or type, conventional bathtubs have raised walls that the user must step over, or steps that the user must climb in order to use the tub. Many people have temporary or permanent disabilities that render the use of a conventional bathtub difficult or impossible, even with the assistance of a nurse or other caregiver. (As used herein, the term "disability" refers to any condition, temporary or permanent, that hinders a person's access to and use of conventional bathtubs and/or showers. Such disabilities include paraplegia, missing limbs, fractures, osteoporosis, impaired balance, arthritis, multiple sclerosis, and so forth.) In the United States alone, over six million people routinely use a mobility-assisting device such as crutches, canes, wheelchairs, scooters, and the like; over four million people have difficulty taking a bath or shower; and almost three million need personal assistance in taking a bath or shower. Thus, there is a growing market for universally-accessible bathroom designs, a market that is anticipated to parallel the increase in the average age of the U.S. population and growing awareness of the needs of disabled persons and the elderly. A variety of devices are available to assist disabled persons in bathing, showering, etc., ranging from non-skid surfaces and sturdy grab bars to bath lifts, fixed or swiveling bathtub seats, and tubs with access doors. Presently-available devices include tubs with access doors such as those made by the Silcraft Corporation of Traverse City, Minn. and the Kohler Company of Kohler, Wis.

Bathtub devices are shown in a number of U.S. Patents, including Bourgraf, et al. (Des. 351,018) and Sween (Des. 285,346), which disclose ornamental designs for bathtubs. U.S. Pat. No. 5,701,614 issued to Appleford, et al. shows a bathtub having a side opening which extends over the full width and height of the bath and is surrounded by an outwardly and downwardly extending skirt. A door with a channel on its inner surface is upwardly translatable in its own plane to bring the door over the opening and force the skirt into sealing engagement with a seal in the channel. The seal may be a foamed rubber seal or a part fluid-filled flexible tube.

McAllister, et al. (U.S. Pat. No. 5,463,780 disclose a ramp which is pivotable from a generally horizontal position for elevating wheel chairs into a shower or other location to a generally vertical position which uses the ramp to hold shower curtains within the shower. The ramp has a dam which prevents water from running onto the floor.

Sills, et al. (U.S. Pat. No. 5,446,929) show a bath tub with a main tub body, a door support, a tambour door assembly, a door seal, and a control system. The tambour door is in a horizontal position under the floor when open and in a vertical position closing the open side of the main tub body when closed. The seal includes an inflatable tube.

Sween (U.S. Pat. No. 5,255,400) discloses a bathing tub apparatus that includes a tub with a sealable door, a prefillable reservoir positioned above the tub, and a support unit which includes a storage cabinet, a liquid circulation system, and a hand-held shower. The reservoir is held by the support unit. The Sween device also includes a hand held shower that may be used by the person in the tub.

Williams (U.S. Pat. No. 4,953,241) shows a bathtub with an entrance wall with an opening which conforms to the shape of the door, a front wall adjacent to the entrance wall, a seat located in the tub, and a locking mechanism which can secure the door in an open or closed position. The front edge of the door is attached adjacent to the front wall of the bathtub by a double axis hinge. When the door is opened, its front edge is guided directly inwardly in the tub by a tracking mechanism; the door is configured so that, during movement, it does not swing over the seat.

Corlew (U.S. Pat. No. 4,796,312) provides a bath tub having side walls, a rear wall, an entrance, and a door for closing the entrance. The entrance has a seal engageable with a chamfered inner surface of the door when the door is closed and water pressure is exerted on the seal.

Schenström (U.S. Pat. No. 4,672,693) discloses a tub having an opening extending almost down to the bottom of the tub and a hatch to close the opening. The hatch is placed on the inside of the bathtub and the hydrostatic forces of the water force the hatch against the edges of the opening where a seal is provided on the hatch.

S Houle, et al. (U.S. Pat. No. 4,546,506) disclose a bathtub with an access opening in one side, and a vertically sliding door to close the access opening, a combination door guide and grab bar arrangement, an adjustable control console, and a power door lock which securely closes the door without significant manual effort.

Budlong (U.S. Pat. No. 4,034,424) provides an auxiliary bathtub mounted above a conventional bathtub, including a rectangular frame approximating the shape of a conventional bathtub and a flexible waterproof liner extending between the side and end walls of the frame and along the inside faces thereof to form a watertight container. At least one of the side walls pivots downwardly to allow entry and exit from the tub, and is held in its upright position by a releasable latching mechanism.

Finch, et al. (U.S. Pat. No. 3,864,762) show an elevated bathtub with a floor supported at approximately normal chair height and a side opening serving as en entryway through one of the walls of the tub. The entryway is provided with a water-tight barrier which may be moved out of the way to permit a person to enter the tub, and replaced once the person is inside the tub.

In addition to the above-described bathtubs, "walk-in" and "wheel-in" showers are becomingly increasingly common in hospitals, nursing homes, and even private homes designed for accessibility. However, showers cannot duplicate the therapeutic effects of soaking in a bathtub, and many people simply prefer tub baths to showers. Some estimates suggest that the United States market for accessible bathtubs could easily approach 30,000 or more per year. However, it is believed that presently available bathtub designs do not satisfactorily address the needs of the large and growing population of individuals who cannot use a conventional bathtub.

Many of the above-described bathtubs require more space for doors, tracks, lifts, water reservoirs, and other components than is available in typical bathrooms. Many are also complex, high-maintenance, and prohibitively expensive for all but institutional use.

This invention relates generally to the design and construction of bathtubs and bathtub/shower combinations, and more specifically to the design and construction of bathtubs and bathtub/shower combinations that address the unique needs of persons with disabilities. Appropriate bathtub designs for this group would not only help such persons in an important activity, but also reduce a major occupational hazard of nurses and other caregivers: sprained/strained backs and shoulders that result from assisting patients into and out of conventional bathtubs. The emphasis of the present invention is to provide a bathtub or combination bathtub/shower apparatus that people with disabilities can use to care for themselves and maintain an independent lifestyle (the terms "bathtub," "bathtub/shower," "bathtub apparatus" and "bathtub/shower apparatus" are used interchangeably in the following specification).

A bathtub apparatus that addresses these needs should have the following features:

1. As a baseline criterion, the bathtub must be accessible, without assistance, by a person in a wheelchair.

2. The bathtub should preferably be dimensioned to be comparable to a full-sized, soak-bath type bathtub, and accommodate virtually everyone (except perhaps, a small percentage of the population due to size or weight considerations). The user should be able to access and control the water temperature, flow rate, and drain.

3. The bathtub should be capable of being installed in a typical bathroom, either as a new installation or retrofitted to an existing unit.

4. The bathtub should be usable by substantially all persons. Non-disabled users (that is, those without conditions that restrict their access to conventional tubs and showers) should be able to use the bathtub to bathe and/or shower in a normal manner; disabled users should be able to bathe and/or shower with minimal risk of falling.

5. The bathtub must be cost-effective and easily installed.

Designing such a bathtub apparatus requires an understanding that, for a person with disabilities, bathing—or being bathed—involves not just the act of bathing itself (i.e., the act of immersing a person in a liquid for cleaning). It also encompasses people-handling in the psychological and physiopsychological sense: understanding and accommodating the desire for independence, dignity, safety, and security, combined in many instances with a reluctance to ask others for help.

In U.S. Pat. No. 6,151,727, entitled "Bathtub for Persons With Digabilities," I disclose a bathtub apparatus with a pivotable front panel and an elevated bed that allows direct lateral access by the user (that is, a user can access the bathtub directly by stepping into the open tub, sitting on the seat and moving his or her feet into the tub, or sliding from a wheelchair to the seat). The bathtub can be installed in a new or remodeled bathroom. It can also be installed above an existing conventional bathtub, thereby avoiding the necessity of removing the old tub before installing the new one.

Despite the variety of presently-available bathtubs of various shapes and sizes, and of varying accessibility, there is a continuing need for a cost-effective, maximally-accessible tub which can be installed in new or existing bathrooms in residential, commercial (hotel, motel, etc.) and institutional (hospital, nursing home, assisted living facility, etc.) settings.

SUMMARY OF THE INVENTION

According to its major aspects and broadly stated, the present invention is an accessible bathtub apparatus having a floor panel, a wall panel, a movable front panel or door panel that can be opened to permit access into (and out of) the bathtub, a door seal, and pivotable connectors operable to move the door panel from a first, open position to a second, closed position. One end of the floor panel forms a stationary, raised tub bed or seat on which the user's back or buttocks rest; the other end forms a foot well. The wall panel, which is preferably integrally formed with the floor panel, may include head, rear, and foot panels (also termed "end walls") analogous to those found in conventional bathtubs. The floor panel, the wall panel, and the movable front panel cooperate to form a liquid-containing enclosure. The apparatus, hereinafter referred to as "Alden's Tub" or the "ATI Tub," permits direct lateral movement by the user to and from the tub bed: a nondisabled user can access the apparatus directly by stepping into the open tub; a disabled or nondisabled user can sit down on the seat and move his feet into the tub; a disabled user can slide from a wheel-chair to the seat. These modes of access are referred to herein as "direct access," "direct lateral access," or "direct lateral movement."

The apparatus can be provided as a stand-alone model which is generally similar to a conventional bathtub/shower or bathtub/shower combination. A drop-in model which is installed in a platform base (similarly to installation of a kitchen sink in a cut-out or recess in a kitchen counter), but is otherwise similar to the stand-alone type. A portable model which can be installed on an existing conventional bathtub such as those typically found in private homes, hotel or motel rooms, and other facilities, thereby avoiding the necessity (and expense) of removing the old tub before installing the new one. The invention can be used in private homes, hotels and motels, dormitories, hospitals, nursing homes, assisted living facilities, and other locations; it can be used by persons with disabilities that would otherwise preclude them from bathing unattended or unassisted.

Its versatility and cost-effectiveness constitute major features of the present invention. Most bathrooms, either new or existing, have been designed to utilize either right-handed or left-handed bathtubs (i.e., bathtubs having plumbing fixtures and drainage either at the right or left side as the user faces the tub); some have centrally located plumbing. Existing bathtubs and bathtub/shower combinations come in a wide variety of sizes, types and configurations, some having built-in Jacuzzi™ or other whirlpool units, water heaters, and other devices intended to add to the user's comfort and convenience. The ATI Tub can be installed instead of another type of bathtub; alternatively, it can be retro-fitted—permanently or temporarily—to the vast majority of presently-existing bathtubs. Because the ATI Tub has no "handedness," it can be used with either left-handed or right-handed plumbing fixtures.

As will be seen in the Detailed Description, the ATI Tub is simpler to manufacture and requires less materials and labor than other known designs, therefore resulting in a more cost-effective product. The ability to quickly and easily install the ATI Tub over an existing conventional bathtub reduces installation costs, since there is no need to demolish and remove the old tub before installing the new one.

An important feature of the present invention is the movable front, door panel which permits direct lateral access by the user. The front panel may extend the full length of the ATI Tub or only a portion of the length, and may take a number of different forms to permit it to be moveable and sealable relative to the stationary parts of the tub as will be described in detail below.

Depending on the needs and preferences of the user, the front panel may be bottom-hinged for a fold-up/fold down motion, side-hinged for lateral swing-out/swing-in motion, a banker's roll-top desk type of panel, a pivotable panel that pivots up or down about a pivot point away from the panel itself, or a parallelogram type panel utilizing two lever arms and pivot points at the ends of the tub. A variety of different type of seals may conveniently be used with the invention, including but not limited to compression-type seals such as are used with refrigerator doors, pneumatically-inflatable or hydraulically-inflatable seals, and diaphragm-type seals. In a preferred embodiment of the invention, the front panel is pivotable between its open and closed positions. Retainers, spring-loaded pivots, or other suitable devices hold the front panel in its open position during ingress and egress by the user.

Another feature of the present invention is the elevated tub bed, which is at a comfortable seating height when the bathtub is installed. Typical heights are approximately 15"–16" (about 38–41 cm) above floor level, although heights outside this range may also be useful. This feature permits a person to move laterally to and from the ATI Tub from a wheelchair, for example, by sliding (with assistance if needed) from the wheelchair onto the tub bed.

Still another feature of the present invention is the foot well, which is preferably located at the same end of the ATI Tub where the water valves, nozzle, and drain would be located in a conventional bathtub. The foot well may be approximately 24"×24" (about 61×61 cm) in horizontal dimensions and approximately 12" (about 30 cm) deep, and serves several functions: (a) it increases the effective length of the ATI Tub for tall users so that all portions of the body, including the knees, can be submerged; and (b) it permits non-disabled users to both bathe and shower in a conventional manner.

Yet another feature of the present invention is the ability to fit it to an existing bathtub. Many conventional bathtubs have one or more ledges at the sides or back, together with a front wall which a user must step over to access the tub. In tubs having adequate ledges, recesses, or other structural features for support, the invention can be installed so that the enclosure rests on the ledges. Supplemental longitudinal and lateral supports, expanded plastic foam, or other devices may be used to fix it permanently in position. Alternatively, the invention may be supported by brackets attached to the existing tub and/or the surrounding walls. Pallets that interface the invention to the existing tub, filler materials, or shims may also be used where appropriate.

Other features and advantages of the present invention will be apparent to those skilled in the art from a careful reading of the Detailed Description of Preferred Embodiments presented below and accompanied by the drawings.

DETAILED DESCRIPTION OF PREFERRED EMBODIMENTS

Figure 1:
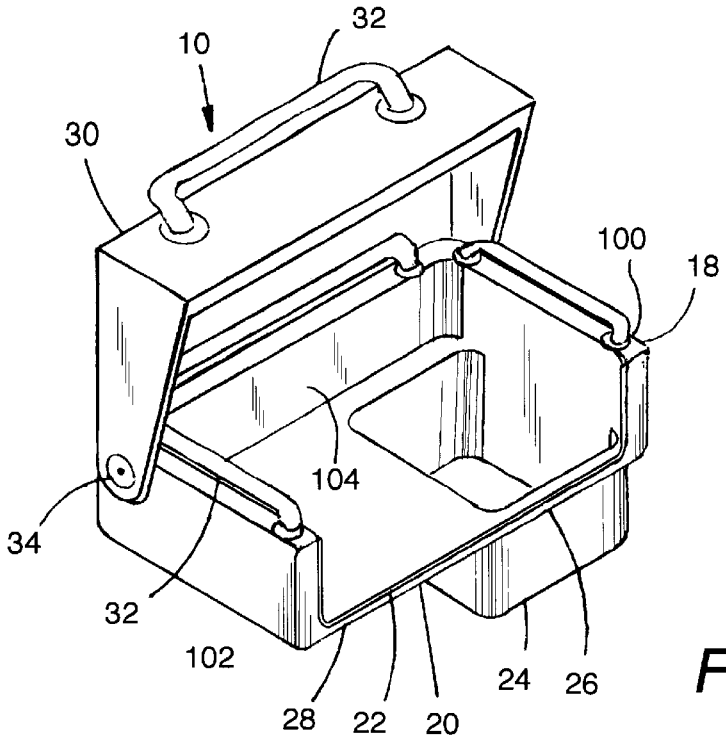
FIG. 1 is a schematic, isometric view of a portable bathtub apparatus according to a preferred embodiment of the present invention.

In the following description, reference numerals are used to identify structural elements, portions of elements, or surfaces in the drawings, as such elements, portions or surfaces may be further described or explained by the entire written specification. For consistency, whenever the same numeral is used in different drawings, it indicates the same element, portion, surface and area as when first used. As used herein, the terms "horizontal," "vertical," "left," right," "up," "down," as well as adjectival and adverbial derivatives thereof, refer to the relative orientation of the illustrated structure as the particular drawing figure faces the reader. It should be understood that only those components having particular functional importance or that would not otherwise be identified have been assigned reference numerals.

Referring now to FIG. 1, there is shown a bathtub apparatus 10 ("Alden's Tub" or "ATI Tub") according to a preferred embodiment of the present invention. Bathtub 10 includes a wall panel 18, and a floor panel 20 with a tub bed or seat portion 22 and a recessed foot well portion 24. Wall 18 includes a head end wall, rear side wall, and foot end wall analogous to those found in conventional bathtub installations, being readily identifiable and therefore not numbered.

Foot well 24 has a drain 26, sealable with a conventional elastomeric drain plug or some other suitable means. Tub bed 22 and foot well 24, together with wall 18, are stationery when bathtub 10 is installed for use, whether the installation is temporary or permanent. Tub bed 22 (and foot well 24, if desired) may have textured surfaces for increased traction. Alternatively, textured strips or mats of non-slip material may be attached to tub bed 22 and foot well 24. Bathtub 10 is illustrated schematically: the tub may have generally flat, rectangular walls as shown herein, or gently curved edges and surfaces to further user comfort and esthetic appeal. If desired, tub bed 22 may be contoured to form a comfortable seat for the user.

A pivotable door or front panel 30 is connected to the stationary portions of bathtub 10 by any suitable means, preferably by two off-center cam pivots 34 located at each end of front panel 30 as will be described further below. A seal (for example, the seal shown schematically as 28) seals front panel 30 to wall 18 when the panel is in a closed position. Front panel 30 may have handles, hand rails, or grab bars permanently attached thereto, such as a grab bar 32, to assist the user in maneuvering into and out of bathtub 10. Additional hand rails, of any convenient size and design, may be attached to the side walls and rear wall of bathtub 10. For stability, grab bars 32 are preferably fixed in position.

Figure 2:
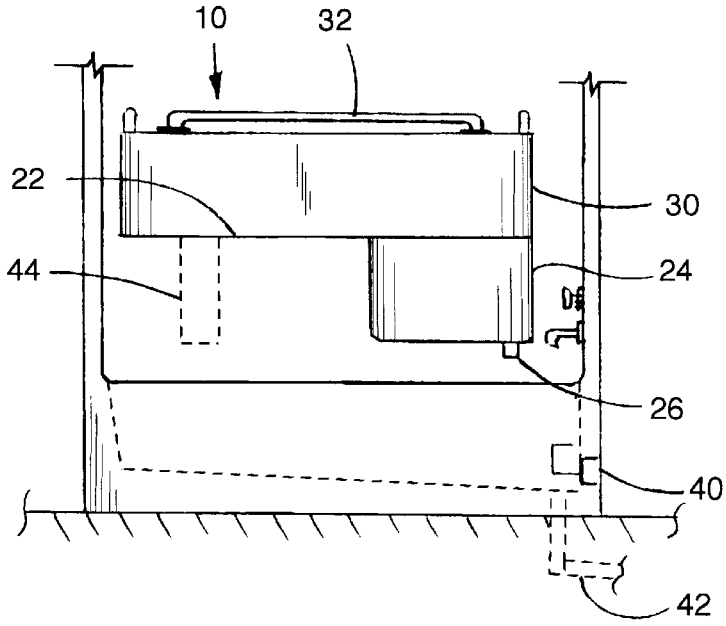
FIG. 2 is an orthographic view of the bathtub apparatus of FIG. 1, shown positioned above an existing bathtub/shower combination in preparation for installation.

FIG. 2 shows the bathtub of FIG. 1 suspended over a conventional bathtub or combination bathtub/shower 40 having a permanently-installed drain 42 (the water supply nozzle and valving for bathtub 40 are indicated but not numbered). It should be understood that bathtub 40 and associated plumbing are usable with the invention, but do not form part of the invention. Bathtub 10 includes pivotable front panel 30, as well as foot well 24, drain 26, and the other above-described portions of the ATI Tub.

Figure 3:
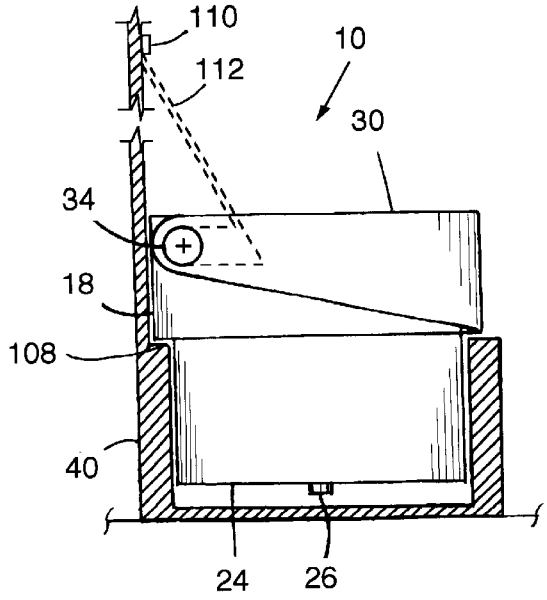
FIG. 3 is an end elevation view of the bathtub apparatus of FIG. 1, showing the apparatus installed in an existing bathtub having front and rear ledges, wherein the apparatus is supported by such front and rear ledges.

An optional auxiliary rear support 44 is shown schematically in FIG. 2. Support 44 may be included when bathtub 10 cannot readily be supported in position by pre-existing bathtub ledges and the like (as shown in FIG. 3 and discussed under FIG. 4).

In use, front panel 30 of bathtub 10 is raised to the upright, "open" position shown in FIG. 1 and the user moves into the bathtub in one of several ways: with or without assistance from a nurse or other caregiver, the user moves to a sitting position with his or her buttocks resting on tub bed 22 and feet in foot well 24. An ambulatory user may simply step into bathtub 10 and sit down on tub bed 22. Alternatively, to minimize the risk of falling while stepping into bathtub 10, he may sit down on tub bed 22, swing his feet into foot well 24, and turn so that he is facing afoot end wall 100 with his back towards a head end wall 102. A user seated in a wheelchair pulls himself parallel to bathtub 10 at tub bed 22 facing foot end wall 100, moves the arm rest of the wheelchair out of the way, and, holding onto the wheelchair for support if needed, slides onto tub bed 22. Once seated on tub bed 22, he lifts his legs (with assistance if needed), together or one at a time, into foot well 24. Thus, tub bed 22 combines the functions of a seat and a transfer surface that a mobility-impaired person can use for entering and leaving bathtub 10. Tub bed 22 preferably meets the ANSI (American National Standards Institute) standard for a transfer surface (i.e., at least approximately 15" (about 38 cm) deep).

After the user is seated in bathtub 10, he or she lowers front panel 30 to its closed position. Panel 30 may also include an interior handle or other device (not shown) whereby the user may open and close the panel while seated on tub bed 22 or while standing in foot well 24.

Front panel 30 is then lowered and locked into its "closed" position (as indicated in FIG. 2), and a drain seal put into drain 26. With front panel 30 in the closed position, front panel 30, wall 18, and floor 20 form a substantially water-tight (i.e., fluid-tight, liquid-tight) enclosure. Hot and cold water is introduced into bathtub 10 by means of a hose and handheld shower head or other suitable plumbing (such plumbing is not a part of this patent application).

Upon completion of bathing, drain 26 is opened and water from bathtub 10 drains into existing tub 40 and drain 42. Front panel 30 is again raised. The user exits bathtub 10 by standing and moving out of the bathtub, or by sliding from seat 22 to a waiting wheelchair. If the user requires assistance, that assistance is substantially enhanced because a caregiver can quickly and easily operate front panel 30 and has ready access to the interior of bathtub 10. For those users needing assistance to enter or leave bathtub 10, the caregiver may be able to help the user slide onto tub bed 22 rather than having to lift him or her into the bathtub. This feature facilitates assistance by a family member, thereby delaying the necessity for hiring professional caregivers or moving to a nursing home.

Most existing, conventional bathtubs have a front wall which a user must step over to access the tub. Many of these bathtubs have a ledge at the opposite wall; some also have ledges at the front and/or foot end walls. Bathtub 10 can be installed in substantially all existing bathtubs, some of which may require the use of appropriate supplemental supports, expanded plastic foam, and other such devices as are known in the art.

For example, FIG. 3 is an end elevation view of an ATI Tub according to the present invention installed in an existing bathtub as described above, wherein bathtub 10 is shown fully inserted into the existing tub 40 and supported along its sides by a front wall 106 and a rear ledge 108 of the existing tub (for clarity, tub 40 is shown in cross-section). Pivotable front panel 30 is shown in its closed position.

Figure 4:
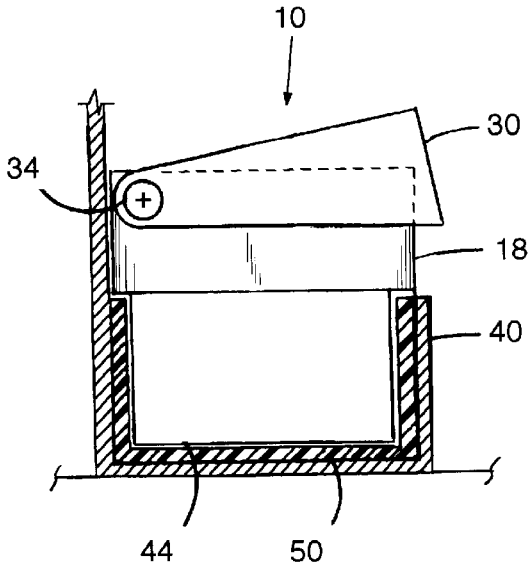
FIG. 4 shows the bathtub apparatus of FIG. 1 installed in an existing bathtub, wherein a supplemental filler material is provided between the apparatus and the existing bathtub.

FIG. 4 is an end elevation view of an ATI Tub with an auxiliary rear support 44 installed in an existing bathtub 40 (as in FIG. 3, tub 40 is shown in cross-section). Support 44 may be configured to provide lateral and/or longitudinal support for bathtub 10 as may be needed. Alternatively, bathtub 10 may be supported by suitable brackets attached to bathtub 40 and/or the surrounding walls. Bathtub 10 may also be partly supported by a recess or other structural feature in bathtub 40. For some existing bathtub installations, pallets that interface the existing bathtub 40 to bathtub 10 may be provided. Such pallets would be cut to whatever size and shape may be needed.

In an exiting installation where there are insufficient ledges, recesses or other structural features for supporting bathtub 10 and where brackets are not feasible, a filler material or shims may need to be installed between the bed and sidewalls of tub 40 and support 44 (if present) and foot well 24 of bathtub 10. The filler material may take any of several different forms. By way of example, thin-walled, flexible plastic sleeves may be positioned under support 44 and foot well 24, and chemicals injected therein to form a foamed-in-place, expandable plastic filler material (indicated generally as 50). However, it will be understood by those of ordinary skill that other types of filler or shim may also be suitable for use with the invention.

When raised to an open, generally upright position, front panel 30 may be held in that position by any suitable fasteners, including but not limited to latches, clips, snaps, clamps, hooks, magnetic retainers, or other suitable devices indicated schematically as 110 (FIG. 3). Alternatively, at least one hydraulic or pneumatic cylinder, spiral spring, spring-loaded counterbalance, or other suitable device (indicated schematically as 112) may retain front panel 30 in an upright position when the panel is raised, but allow the user (or caregiver) to easily lower the panel to its closed position when desired. Where device 112 includes a counterbalance, the device may include provision for adjusting the spring tension, and optionally an adjustable stop for positively locating front panel 30 in the open position.

Figure 5A:
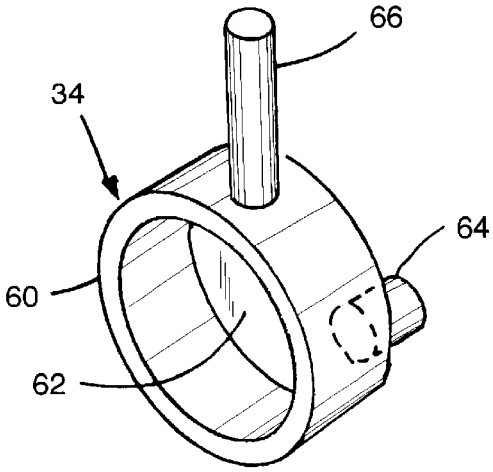
FIG. 5A is an isometric view of the off-center cam used as a pivot point for the front panel of the bathtub of FIG. 1.
Figure 5B:
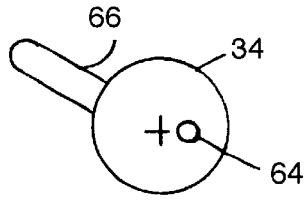
FIGS. 5B and 5C show the cam of FIG. 5A in "closed" and "open" positions, respectively.
Figure 5C:
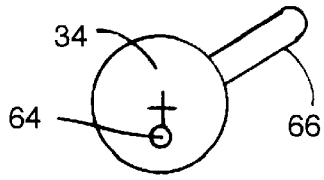
Figure 5D:
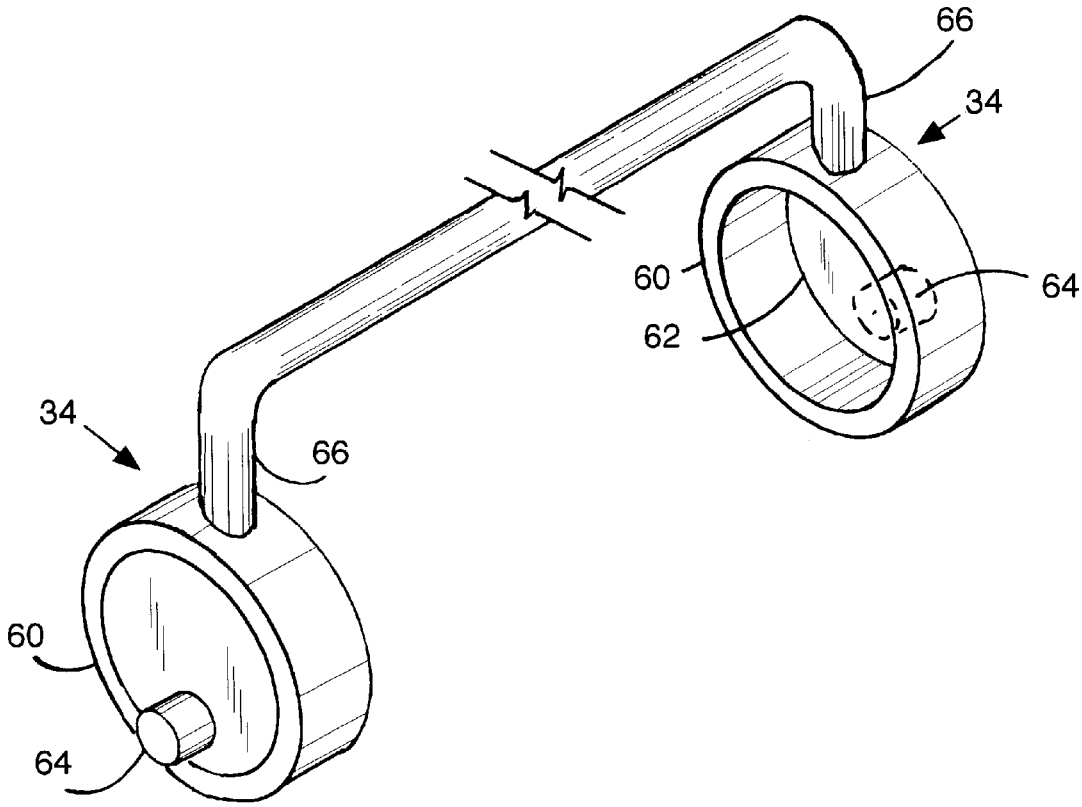
FIG. 5D shows two off-center cam pivots connected by a lever arm.

Turning now to FIGS. 5A–C, there are shown detail views of off-center cam pivot 34 of FIG. 1. Pivot 34 includes a generally circular outer body pivot 60, a rear plug 62, and an off-center pivot 64 which is inserted into a suitable bushing in the wall of bathtub 10. In a preferred embodiment of the present invention, bathtub 10 includes two such pivots 34, one at each end of front panel 30 (as shown schematically in FIG. 5D). A rigid operating lever arm 66 in the form of an inverted "U" connects the two pivots 34, causing the pivots to operate essentially in unison when lever arm 66 latches or unlatches front panel 30 against bathtub 10. However, other pivot means may also be useful for the practice of the invention.

Figure 6:
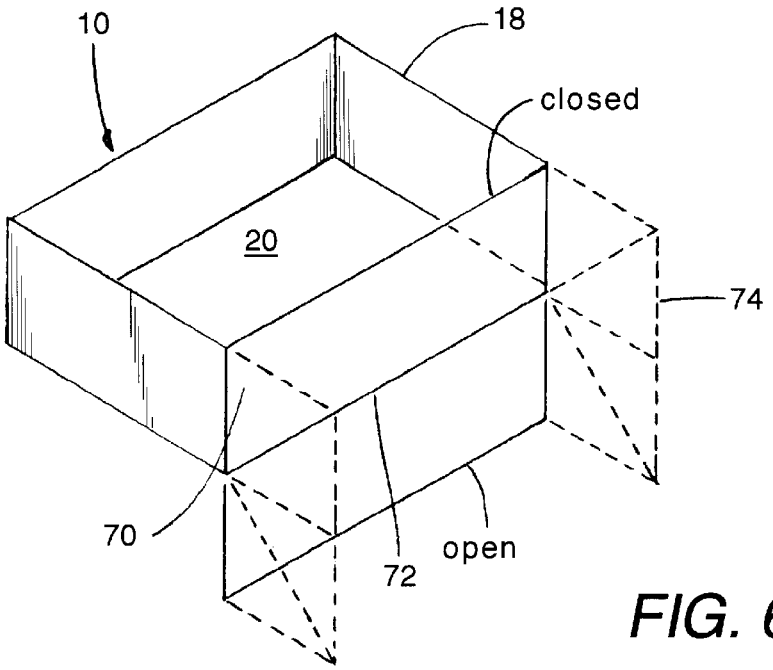
FIG. 6 is an isometric view of a bottom-hinged, fold-down front panel utilizing folded diaphragms for leak-proof sealing, showing the panel in the "closed" position.

FIG. 6 shows another preferred embodiment of the invention, wherein a front panel 70 is hingedly connected to the stationary portions of bathtub 10 at a lower edge 72. Panel 70 is movable between the "open" and "closed" positions indicated in FIG. 6. Sealing of panel 70 to bathtub 10 may be accomplished by any convenient means. By way of example, an elastomeric strip may cover the hinge, and be attached to both tub bed 22 and front panel 70. Alternatively, folded elastomeric sheet diaphragms 74 may be connected between the front and the end walls of bathtub 10. Latching of front panel 70 can be accomplished in a number of different ways within the spirit of the present invention.

Figure 7A:
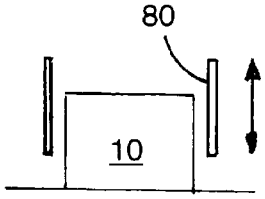
FIGS. 7A–E are schematic, end elevation views of moveable front panels usable with the invention.
Figure 7B:
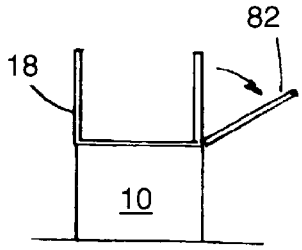
Figure 7C:
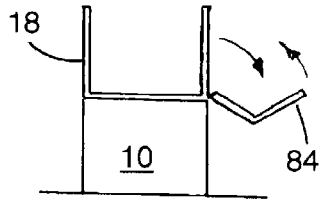
Figure 7D:
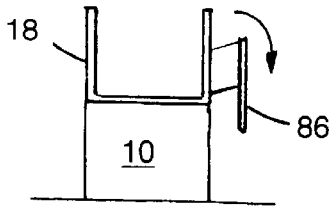
Figure 7E:
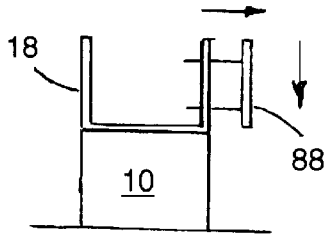

FIGS. 7A–7E illustrate schematically a variety of additional front panel or door designs usable with the present invention. By way of example, FIG. 7A shows the operation of a front panel 80 that includes a rolling diaphragm-type seal. FIG. 7B shows a bottom-hinged fold-down front panel 82 such as that shown in FIG. 6. Alternatively, front panel 82 may be side-hinged for lateral swing-out/swing-in motion if preferred. Other designs include a folding panel 84 (FIG. 7C), a pantograph-type panel 86 (FIG. 7D), and a two-way slide panel 88 (FIG. 7E).

From the above narrative, a number of variations and alternatives may be considered as lying within the scope of the present invention. It will be clear to those skilled in the art that factors such as the particular application affect the design approach. The following discussion outlines a few of the major application factors that may impact the design approach.

One factor is the intended market segment for the ATI Tub. Potential markets include hotel and motel chains, retirement and assisted care homes, nursing homes and rehabilitation facilities, hospitals, and private homes. For all of these markets, the purchase of a bathtub for either permanent or temporary installation is an option, whether the bathtub is installed in a newly-designed (or remodeled) bathroom or retrofitted to an existing tub. Other options include renting or leasing a bathtub that can be temporarily installed in an existing bathroom in order to meet a short-term need. A bathtub according to the present invention can help businesses satisfy the requirements of the Americans With Disabilities Act (ADA). The ADA addresses discrimination against individuals on the basis of a physical or mental handicap; it is designed to end physical barriers in the use of public accommodations and transportation.

Another factor is the selection of a particular design. The ATI Tub may be provided as a "stand-alone" model with the above-described features, but which is otherwise similar to a conventional bathtub or combination bathtub/shower. This stand-alone embodiment of the invention may be permanently installable in the user's bathroom. Alternatively, the ATI Tub may take the form of a "drop-in" model which can be installed in a suitably-dimensioned recess in a platform, in a manner similar to installation of a kitchen sink in a cut-out or recess in a kitchen counter. These models, which replace a conventional bathtub installation, may be preferred for new or remodeled bathrooms designed for universal accessibility. Alternatively In another embodiment of the invention, a portable model ATI Tub (such as that shown in FIG. 1) may be installed above an existing conventional bathtub such as those commonly found in private homes, hotels and motels, hospitals, nursing homes, assisted living facilities, etc. While all embodiments of the ATI Tub may be manufactured in any desired size and color, a few standard sizes are preferable from the standpoint of manufacturing and market economics.

A bathtub according to the present invention may be made of any suitable materials, preferably of materials that can be molded by techniques known in the art of bathtub manufacturing. Suitable techniques include spray-molding, roto-molding, blow-molding, compression molding, and injection molding. Lightweight, durable materials such as acrylic resins and other plastics, Fiberglas™, and reinforced plastics (i.e., composites composed of a thermosetting or thermoplastic resin and fibers, filaments, or whiskers of glass, metal, boron, aluminum silicate, etc.) are broadly suitable for use with the invention.

As noted above, a variety of movable front panels may be used with the invention, including but not limited to a bottom-hinged panel for a fold-up/fold down motion, a side-hinged panel for lateral swing-out/swing-in motion, a banker's roll-top desk type of panel, a pivoted panel permitting the movable panel to pivot up or down about a pivot point away from the panel itself, and a parallelogram-type panel utilizing two lever arms and pivot points at the ends of the bathtub. These may be used with all of the above-described models of the ATI Tub, subject to physical restrictions that may exist within any particular bathroom.

A variety of seals are usable with the invention, including but not limited to compression-type seals such as those used for refrigerator doors, pneumatically-inflatable or hydraulically-inflatable seals, and diaphragm-type seals. For example, diaphragm seals such as folded sheets, fan-fold sheets, or rolling diaphragm seals may be used on bottom-hinged or side-hinged panels to make the seal leak-proof.

Typical bathrooms are designed to utilize either right-handed or left-handed bathtubs, that is, plumbing fixtures and drainage are either at the right or left as a person faces the tub, as well as centrally located plumbing. Existing bathtubs and bathtub/shower combinations come in a variety of sizes, types and configurations, ranging from older cast iron tubs that are raised on feet, to newer tubs that have oval or rounded rectangular tub recessions set into the tub structure at an angle. The ATI Tub can be used in essentially all of the above-noted configurations, contributing to both interchangeability and economy in production. The invention has no handedness per se, thus, it can readily be installed for use with existing left-handed or right-handed plumbing fixtures.

A bathtub apparatus according to the present invention is believed to be simpler to manufacture, and require less materials and labor than other designs for accessible bathtubs, therefore resulting in a cost-effective product. In one embodiment of the invention, bathtub 10 can be used in place of conventional bathtubs (or bathtub/shower combinations) for new construction or renovations. In another embodiment, the portable model of the invention can be installed quickly and easily over an existing conventional bathtub. The principal advantages of portability are two-fold: the reduced costs associated with not having to remove an existing bathtub and permanently install a new tub, and the capability to quickly (and, if need be, temporarily) retrofit the ATI Tub to an existing installation. For instance, rather than remodeling an existing bathroom, a motel operator can install a portable ATI Tub in a bathroom for a customer that may only need the tub for a night or two. A homeowner can likewise install a portable ATI Tub, temporarily or permanently, for use by a resident or guest.

Based on assessments of existing companies that produce bathtubs for persons with disabilities, there are no known products that compete with the ATI Tub concepts, and therefore the hotel/motel, institutional (hospital, nursing home, etc.) and the private residential markets. The testing markets (hotels and motels, hospitals, nursing homes, private homes, etc.) are estimated at more than 150,000 units over a period of five years. However, the market for accessible design is anticipated to increase substantially over the coming years, paralleling the increase in the average age of the U.S. population and growing awareness of the needs of disabled persons and the elderly.

With respect to the above description of the invention, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Thus, it will be apparent to those skilled in the art that many changes and substitutions can be made to the preferred embodiment herein described without departing from the spirit aid scope of the present invention as defined by the appended claims.

What is claimed is:

1. A bathtub, comprising:

a floor panel;

a wall panel attached to said floor panel, said wall panel including a head end wall, a rear side wall, and a foot end wall, said wall panel and said floor panel defining a bathtub enclosure with an opening;

a door panel;

means for pivotably securing said door panel to said head end wall and said foot end wall adjacent to said rear side wall of said enclosure, said securing means operable to pivot said door panel from a first position above said enclosure wherein a user can access said enclosure through said opening to a second position wherein said door panel closes said opening;

means for sealing said door panel to said enclosure so that said enclosure is substantially water-tight when said door panel is in said second position; and retaining means operably connected to said door panel, said retaining means operable for holding said door panel in said first position.

2. The bathtub as recited in claim 1, further comprising support means for fitting said enclosure to an existing bathtub.

3. The bathtub as recited in claim 1, wherein said floor panel further comprises a seat portion and a foot portion, said seat portion being above said foot portion.

4. The bathtub as recited in claim 1, wherein said wall panel is integrally formed with said floor panel.

5. The bathtub as recited in claim 1, wherein said securing means further comprises a pivotable connector.

6. The bathtub as recited in claim 1, wherein said enclosure is molded of a material selected from the group consisting of plastics, acrylic resins, reinforced plastics, and Fiberglas®.

7. The bathtub as recited in claim 1, wherein said enclosure is molded of a composite material.

8. The bathtub as recited in claim 1, wherein said sealing means further comprises a compression seal, an inflatable seal, or a diaphragm seal.

9. A bathtub, comprising:

a floor panel having a perimeter, said floor panel having a seat portion and a foot portion;

at least one wall panel attached to said floor panel along a major portion of said perimeter so that said at least one wall panel and said floor panel form a bathtub enclosure having an access opening;

drain means in said floor panel;

a front panel having a front wall and two spaced-apart side walls;

means for pivotably attaching said side walls of said front panel to said one wall panel at a location opposite said access opening, said attaching means operable to move said front panel from an open position wherein said front panel is above said enclosure to a closed position wherein said front panel closes said access opening;

means for sealing said front panel to said enclosure so that said enclosure is substantially water-tight when said front panel is in said closed position; and means for holding said front panel in said open position, said holding means allowing a user to lower said front panel to said closed position.

10. The bathtub as recited in claim 9, wherein said at least one wall panel further comprises a head end wall, a rear side wall, and a foot end wall.

11. The bathtub as recited in claim 9, wherein said attaching means further comprises a pair of off-center cam pivots, one of said pair of pivots at each side wall of said front panel.

12. The bathtub as recited in claim 9, wherein said at least one wall panel is integrally formed with said floor panel.

13. The bathtub as recited in claim 9, further comprising at least one grab bar attached to said wall panel.

14. The bathtub as recited in claim 9, further comprising at least one grab bar attached to said front panel.

15. The bathtub as recited in claim 9, wherein said floor panel, said front panel, and said at least one wall panel are made of plastics, acrylic resins, reinforced plastics, and Fiberglas®.

16. The bathtub as recited in claim 9, wherein said floor panel, said front panel, and said at least one wall panel are made of a composite material.

17. The bathtub as recited in claim 9, wherein said sealing means further comprises a compression seal, an inflatable seal, or a diaphragm seal.

18. A method for retrofitting a new bathtub to an existing bathtub, said method comprising the steps of:

providing a new bathtub having an enclosure with an opening, a door panel, and means for securing said door panel to said enclosure so that said door panel is movable from an open position wherein a user can access said enclosure through said opening to a closed position wherein said door panel closes said opening; and installing support means interfacing said new bathtub to said existing bathtub, said support means maintaining said new bathtub in position for use.

19. The method as recited in claim 18, wherein said installing step further comprises operably connecting said support means to at least one structural feature of said existing bathtub.

20. The method as recited in claim 18, wherein said installing step further comprises the steps of:

selecting at least one appropriate support from the group consisting of longitudinal supports, lateral supports, pallets, expandable filler materials, expanded plastic foam, filler materials, shims and brackets; and positioning said at least one support so that said at least one support interfaces said new bathtub to said existing bathtub and provides structural support therefor.

21. The method as recited in claim 18, wherein said support means is selected from the group consisting of longitudinal support means between a front and a rear ledge of said existing bathtub, longitudinal support means operably connected to a recess in said existing bathtub, lateral support means operably connected between a front wall and an opposing ledge of a rear wall of said existing bathtub, lateral support means attached to a recess in said existing bathtub, pallet means interfacing said bathtub to said existing bathtub, expanded plastic foam means, expandable filler means, filler means, shim means and bracket means.

22. The method as recited in claim 18, wherein said new bathtub further comprises:

a floor panel;

a wall panel attached to said floor panel, said wall panel including a head end wall, a rear side wall, and a foot end wall, said wall panel and said floor panel defining said new bathtub enclosure;

means for pivotably securing said door panel to said head end wall and said foot end wall adjacent to said rear side wall of said enclosure, said securing means operable to pivot said door panel from a first position above said enclosure wherein a user can access said enclosure through said opening to a second position wherein said door panel closes said opening; and means for sealing said door panel to said enclosure so that said enclosure is substantially water-tight when said door panel is in said second position.

23. The method as recited in claim 18, wherein said new bathtub further comprises:

a floor panel;

a wall panel attached to said floor panel, said wall panel including a head end wall, a rear side wall, and a foot end wall, said wall panel and said floor panel defining said new bathtub enclosure;

means for pivotably securing said door panel to said head end wall and said foot end wall adjacent to said rear wide wall of said enclosure, said securing means operable to pivot said door panel from a first position above said enclosure wherein a user can access said enclosure through said opening to a second position wherein said door panel closes said opening; and a seal for sealing said door panel to said enclosure so that said enclosure is substantially water-tight when said door panel is in said second position, said seal selected from the group consisting of compression seals, inflatable seals, and diaphragm seals.

* * * * *